US006873298B1

(12) United States Patent
Aisenbrey

(10) Patent No.: US 6,873,298 B1
(45) Date of Patent: Mar. 29, 2005

(54) PLASTENNA FLAT PANEL ANTENNA

(75) Inventor: Thomas Aisenbrey, Littleton, CO (US)

(73) Assignee: Integral Technologies, Inc., Bellingham, WA (US)

( * ) Notice: Subject to any disclaimer, the term of this patent is extended or adjusted under 35 U.S.C. 154(b) by 18 days.

(21) Appl. No.: 10/671,265

(22) Filed: Sep. 25, 2003

Related U.S. Application Data

(60) Provisional application No. 60/451,873, filed on Mar. 4, 2003, and provisional application No. 60/413,677, filed on Sep. 25, 2002.

(51) Int. Cl.[7] ..... H01Q 1/12

(52) U.S. Cl. ..... 343/718; 343/820; 343/857; 343/897

(58) Field of Search ..... 343/718, 820, 343/857, 897, 793, 700 MS, 701, 828; H01Q 1/12

(56) References Cited

U.S. PATENT DOCUMENTS

| | | | | |
|---|---|---|---|---|
| 4,722,860 | A | 2/1988 | Doljack et al. | 428/260 |
| 4,968,984 | A | 11/1990 | Katoh et al. | 343/713 |
| 5,005,020 | A | 4/1991 | Ogawa et al. | 343/713 |
| 5,906,004 | A | 5/1999 | Lebby et al. | 2/1 |
| 6,080,690 | A | 6/2000 | Lebby et al. | 442/209 |
| 6,172,650 | B1 | 1/2001 | Ogawa et al. | 343/836 |
| 6,531,983 | B1 | 3/2003 | Hirose et al. | 343/700 MS |
| 6,741,221 | B2 * | 5/2004 | Aisenbrey | 343/897 |
| 2003/0011532 | A1 * | 1/2003 | Yoshinomoto et al. | 343/895 |
| 2004/0164923 | A1 * | 8/2004 | Aisenbrey | 343/895 |
| 2004/0196201 | A1 * | 10/2004 | Aisenbrey | 343/788 |

* cited by examiner

*Primary Examiner*—Hoanganh Le
(74) *Attorney, Agent, or Firm*—George O. Saile; Stephen B. Ackerman; Larry J. Prescott

(57) ABSTRACT

A flat panel antenna, monopole or dipole, formed from a conductive loaded resin-based material containing micron conductive powders or micron conductive fibers to provide conductivity. The monopole antenna has an antenna element having an outer periphery with a length equal to an integral multiple of a quarter wavelength of the desired center frequency of the antenna. A bobbin, also formed of the conductive loaded resin-based material, and is attached to the antenna element by connection elements. A coil of conductive wire, having two ends connected to a coaxial cable, is wound around the bobbin. The coaxial cable can deliver power to a radiating antenna or extract power from a receiving antenna. The dipole antenna has first and second antenna elements both formed of conductive loaded resin-based material. The peripheries of the first and second antenna elements have lengths equal to an integral multiple of a quarter wavelength of a first and second frequency. The center frequency of the antenna is between the first and second frequencies. First and second bobbins, wound with first and second coils of conductive wire are attached to the first and second antenna elements. The first and second coils of wire are connected to a single coaxial cable which delivers power to a radiating antenna or extracts power from a receiving antenna.

30 Claims, 3 Drawing Sheets

PLASTENNA FLAT PANEL ANTENNA

This Patent Application claims priority to the following U.S. Provisional Patent Applications, herein incorporated by reference:

60/413,677, filed Sep. 25, 2002

60/451,873, filed Mar. 4, 2003

BACKGROUND OF THE INVENTION (1) Field of the Invention

This invention relates to a flat monopole or dipole antenna having flat antenna elements formed of conductive loaded resin-based materials and having attached bobbins, also formed of the conductive loaded resin-based materials, on which a number of turns of conductive wire are wound.

(2) Description of the Related Art

Antennas are an essential part of electronic communication systems that contain wireless links. Low cost flat panel antennas offer significant advantages for these systems.

U.S. Pat. No. 6,531,983 B1 to Hirose et al. describes an antenna assembly having patterned conductive films on the surface of a dielectric hexahedron. The conductive films are formed on protuberances formed on the surface of the dielectric hexahedron. Conductive resins can be used in the conductive films.

U.S. Pat. No. 6,172,650 B1 to Ogawa et al. describes an antenna system having a reduced height for use as a tracking antenna system. The ground plane used in the antenna system can comprise conductive plastic material.

U.S. Pat. No. 5,906,004 to Lebby et al. and U.S. Pat. No. 6,080,690 to Lebby et al. describe the use textile fabric which includes conductive fibers.

U.S. Pat. No. 5,005,020 to Ogawa et al. describes a glass antenna using a transparent conductive film. In some constructions a transparent conductive plastic film can be used as the transparent conductive film.

U.S. Pat. No. 4,968,984 to Katoh et al. describe a bar type antenna unit installed at a normally non-visible point on the body of a vehicle. The invention indicates the conductive resin conductive rubber can be used as an antenna element.

U.S. Pat. No. 4,722,860 to Doljack et al. describes the use of a flexible conducting cloth comprising a plurality of intermingled or interwoven refractory fibers. The cloth is useful as an antenna.

SUMMARY OF THE INVENTION

Antennas are essential in any electronic system containing wireless links. Such applications as communications and navigation require reliable sensitive antennas. Antennas are typically fabricated from metal antenna elements in a wide variety of configurations. Lowering the cost of antenna materials or production costs in fabrication of antennas offers significant advantages for any applications utilizing antennas.

It is a principle objective of this invention to provide an economical, low profile, and small area monopole antenna that operates with excellent performance in close proximity to either a conductive or nonconductive surface.

It is another principle objective of this invention to provide an economical, low profile, and small area dipole antenna that operates with excellent performance in close proximity to either a conductive or non-conductive surface.

These objectives are achieved by forming a flat panel antenna from Plastenna conductive plastic which is a conductive loaded resin-based material. The conductive loaded resin-based material contains micron conductive powders or micron conductive fibers to provide conductivity. These materials are resins loaded with conductive materials to provide a resin-based material which is a conductor rather than an insulator. The resins provide the structural material which, when loaded with micron conductive powders or micron conductive fibers, become composites which are conductors rather than insulators. The conductive loaded resin-based materials can be molded, extruded, cut, injection molded, over-molded, laminated, extruded, milled or the like to provide the desired antenna shape and size.

The use of Plastenna conductive plastic, conductive loaded resin-based materials, in antenna fabrication significantly lowers the cost of materials and manufacturing processes used in the assembly antennas and the ease of forming these materials into the desired shapes. These materials can be used to form either receiving or transmitting antennas. The antennas and/or ground planes can be formed using methods such as injection molding, overmolding, or extrusion of the conductive loaded resin-based materials.

The conductive loaded resin-based materials, typically but not exclusively, have a resistivity of between about 5 and 25 ohms per square. The resultant loading mix of conductive powders or fibers to the resin host, by weight, can be between about 14% and 80% in some applications, depending on the specific conductive powders or fibers and resins used.

The conductive loaded resin-based materials, typically but not exclusively, have a conductivity of between about 5 and 25 ohms per square. The antenna elements, used to form the antennas, are formed of the conductive loaded resin-based materials and can be formed using methods such as injection molding, overmolding, or extrusion. The antenna elements can also be stamped to produce the desired shape. The conductive loaded resin-based material antenna elements can also cut or milled as desired.

The conductive loaded resin-based materials comprise micron conductive powders or fibers loaded in a structural resin. The micron conductive powders are formed of metals such as nickel, copper, silver or the like. The micron conductive fibers can be nickel plated carbon fiber, stainless steel fiber, copper fiber, silver fiber, or the like. The structural material is a material such as a polymer resin. The resin-based structural material loaded with micron conductive powders or fibers can be molded, using a method such as injection molding, overmolding, or extruded to the desired shape. The conductive loaded resin-based materials can be cut or milled as desired to form the desired shape of the antenna elements. The composite could also be in the family of polyesters with woven or webbed micron stainless steel fibers or other micron conductive fibers forming a cloth like material which, when properly designed in metal content and shape, can be used to realize a very high performance cloth antenna. Such a cloth antenna could be embedded in a persons clothing as well as in insulating materials such as rubber or plastic. The woven or webbed conductive cloths could also be laminated to materials such as Teflon, FR-4, or any resin-based hard material.

This invention describes both monopole and dipole antennas. In the monopole antenna of this invention an antenna element is formed of conductive loaded resin-based material. The periphery of the antenna element has a length equal to an integral multiple of a quarter wavelength of the desired center frequency of the antenna. A bobbin is formed of the conductive loaded resin-based material and is attached to the antenna element by connection elements also formed of the conductive loaded resin-based material. A coil of conductive wire, having two ends, is wound around the bobbin. One end of the coil of wire is electrically connected to the center connector of a coaxial cable. The other end of the coil of wire is electrically connected to the outer shield of the coaxial cable. The coaxial cable can then either deliver power to the antenna for a radiating antenna or extract power from the antenna for a receiving antenna. As an example the antenna element can have the shape of a disk however other shapes can be used.

In the dipole antenna of this invention a first antenna element and a second antenna element are formed of conductive loaded resin-based material. The periphery of the first antenna element has a length equal to an integral multiple of a quarter wavelength of a first frequency. The periphery of the second antenna element has a length equal to an integral multiple of a quarter wavelength of a second frequency. If the first frequency and the second frequency are different, the center frequency of the antenna will be between the first and second frequencies. If the first frequency and the second frequency are the same, the center frequency of the antenna will be equal to the first and second frequencies. A first bobbin and a second bobbin are formed of the conductive loaded resin-based material. The first bobbin is attached to the first antenna element by connection elements also formed of the conductive loaded resin-based material. The second bobbin is attached to the second antenna element by connection elements also formed of the conductive loaded resin-based material. A first coil of conductive wire, having two ends, is wound around the first bobbin and a second coil of wire, also having two ends, is wound around the second bobbin. One end of the first coil of wire and one end of the second coil of wire are electrically connected to the center connector of a coaxial cable. The other end of the first coil of wire and the other end of the second coil of wire are electrically connected to the outer shield of the coaxial cable. The coaxial cable can then either deliver power to the antenna for a radiating antenna or extract power from the antenna for a receiving antenna. As an example the first antenna element can have the shape of one half of a disk with the second antenna element having the shape of the other half of the disk, however other shapes can be used.

The monopole and dipole antennas of this invention operate with excellent performance in close proximity to either a conductive or a non conductive surface.

DESCRIPTION OF THE PREFERRED EMBODIMENTS

Figure 1:
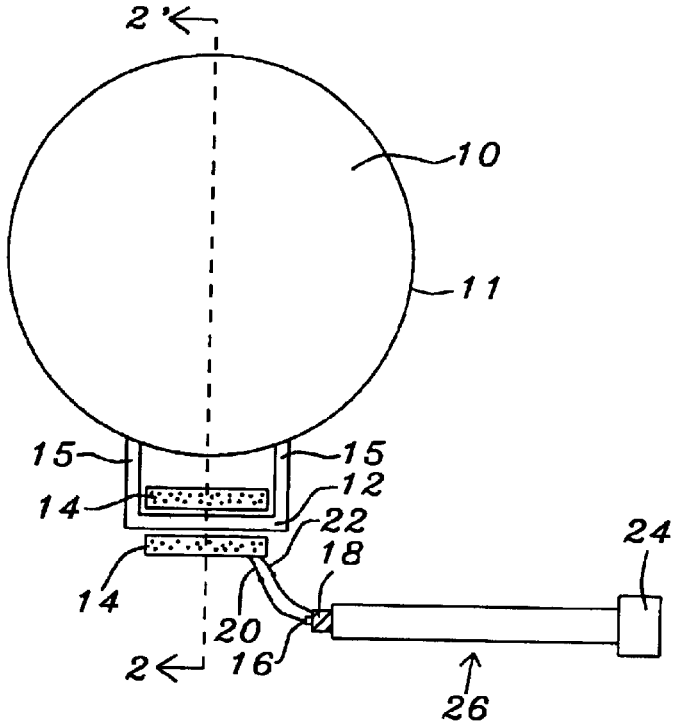
FIG. 1 shows a top view of the monopole antenna of this invention.
Figure 2:
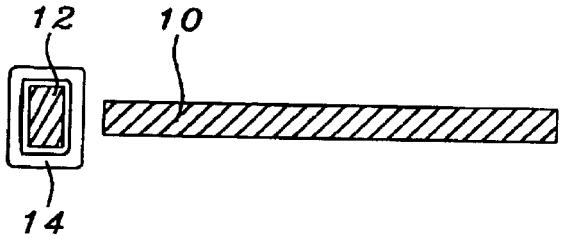
FIG. 2 shows a cross section view, taken along line 2–2' of FIG. 1, of the monopole antenna of this invention.
Figure 3:
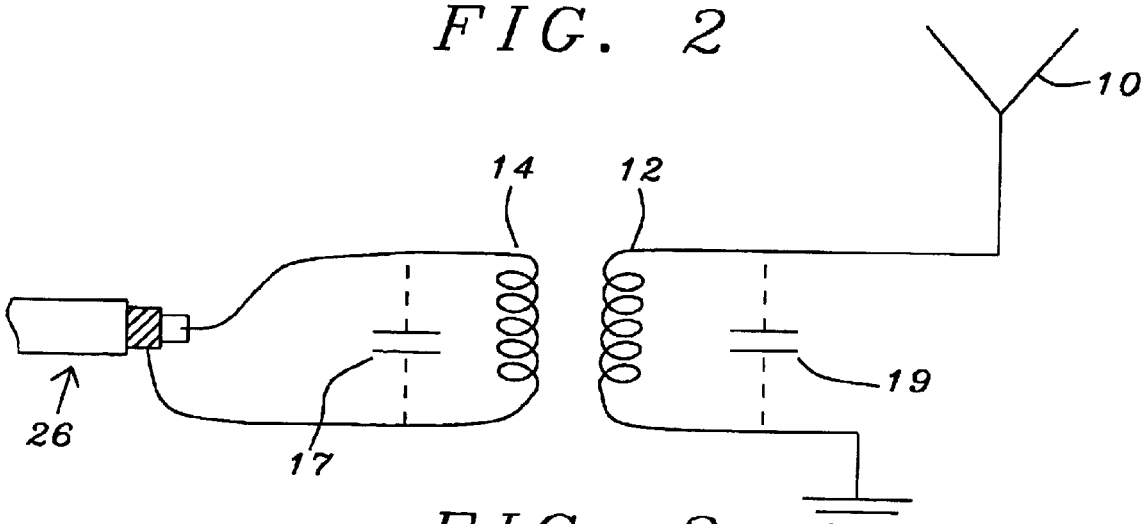
FIG. 3 shows a schematic view of the equivalent circuit of the monopole antenna of this invention.

Refer now to FIGS. 1–3 for a description of the monopole antenna of this invention. FIG. 1 shows a top view and FIG. 2 shows a cross section view, taken along line 2–2' of FIG. 1, of the monopole antenna. The monopole antenna has an antenna element 10 formed of conductive loaded resin-based material. As can be seen from FIGS. 1 and 2 the antenna element has an outer periphery 11, which has a length equal to an integral multiple of one quarter wavelength of the desired optimum frequency of the antenna. In this example the antenna element has the shape of a flat circular disk, however other shapes can be used and work very well. A bobbin core 12 formed of conductive loaded resin-based material is attached to the antenna element 10 by attachment elements 15 also formed of conductive loaded resin-based material. A coil 14 of conductive wire, having a first end 20 and a second end 22, is wound around the bobbin core 12 thereby forming a number of turns of the wire around the bobbin core 12. The conductive wire has an insulating material formed thereon thereby insulating each of the turns of the conductive wire from the bobbin core and from the other turns of conductive wire wound on the bobbin core 12.

As shown in FIG. 1, the first end 20 of the coil 14 of conductive wire is electrically connected to the center connector 16 of a coaxial cable 26, and the second end 22 of the coil 14 of conductive wire is electrically connected to the outer shield 18 of the coaxial cable 26. The coaxial cable 26 is attached to a coaxial cable connector 24. In the case of a radiating antenna power is delivered to the antenna by means of the coaxial cable 26. In the case of a receiving antenna power is extracted from to the antenna by means of the coaxial cable 26.

FIG. 3 shows an equivalent circuit of the monopole antenna of this invention. The equivalent circuit shows the antenna element 10, the coil 14 of conductive wire, the bobbin core 12, a capacitor 17 representing the capacitance of the coil 14 of conductive wire, and a capacitor 19 representing the capacitance of the bobbin core 19. The antenna element is tuned to the center frequency by means of the length of the outer periphery 11 of the antenna element 10 and the number of turns in the coil 14 of conductive wire, thereby controlling the inductance of the coil 14 of wire. The antenna can be tuned to have a center frequency between 3 kilohertz and 300 gigahertz. In one useful configuration the antenna has a center frequency between 137 megahertz and 152 megahertz. The monopole antenna described herein operates with excellent performance in close proximity to either a conductive or a non conductive surface.

Figure 4:
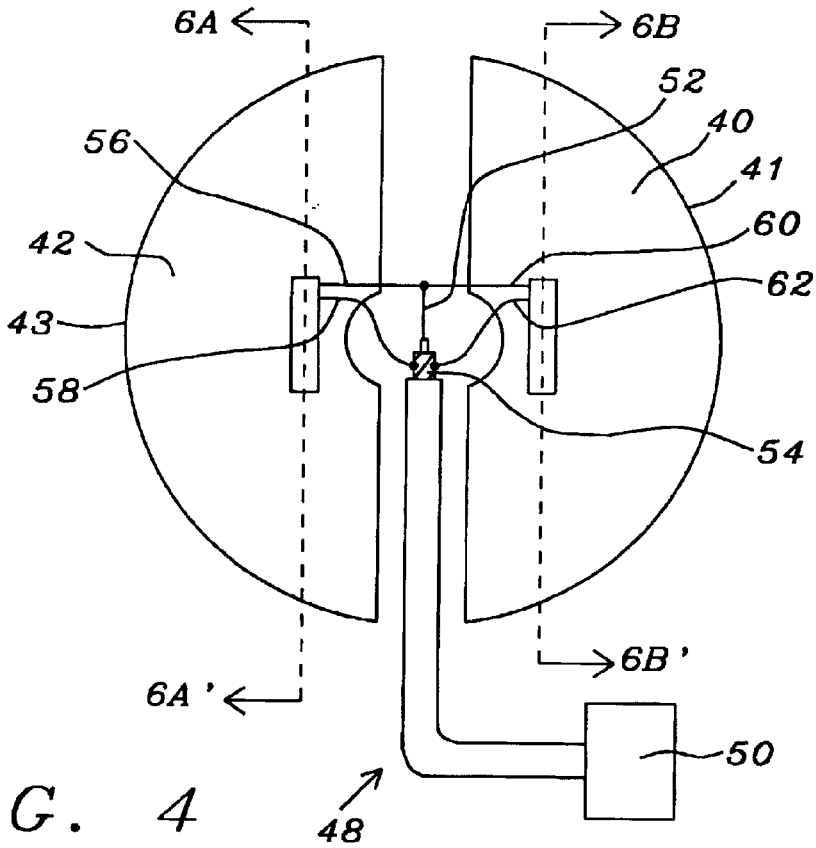
FIG. 4 shows a top view of the dipole antenna of this invention.
Figure 5:
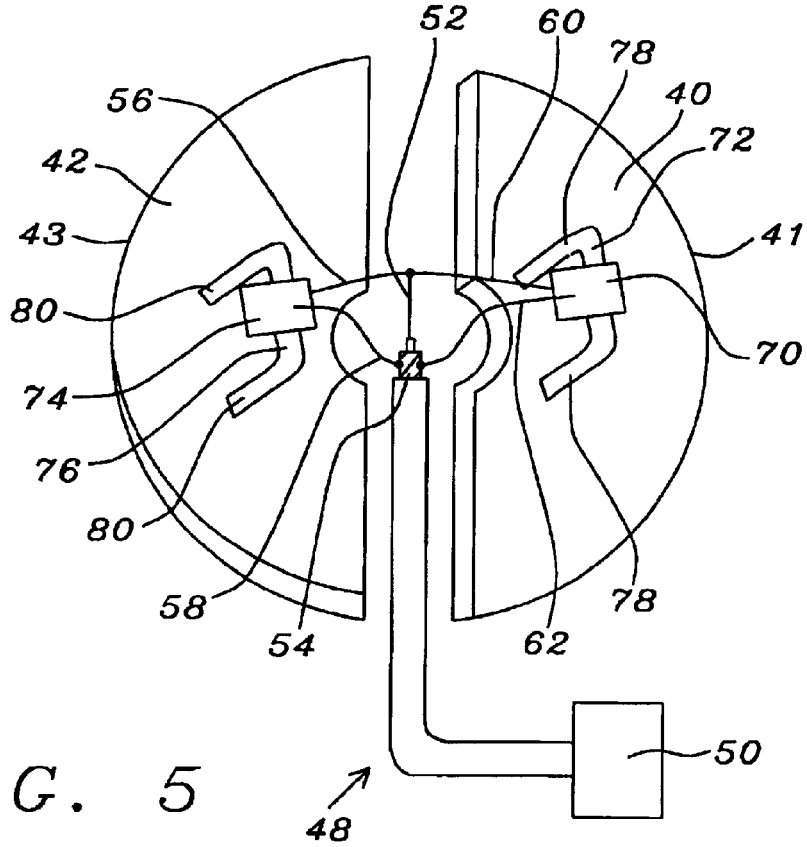
FIG. 5 shows a perspective view of the dipole antenna of this invention.
Figure 6A:
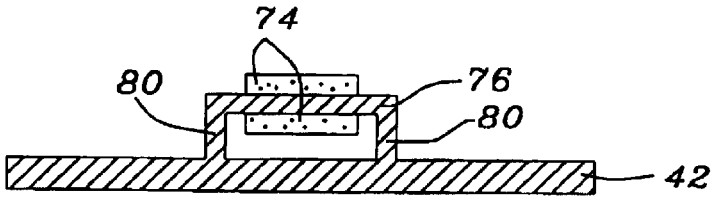
FIG. 6A shows a cross section view, taken along line 6A–6A' of FIG. 4, of the dipole antenna of this invention.
Figure 6B:
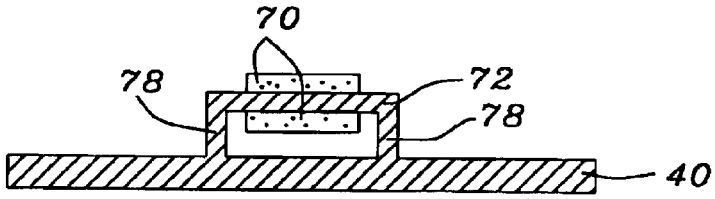
FIG. 6B shows a cross section view, taken along line 6B–6B' of FIG. 4, of the dipole antenna of this invention.

Refer now to FIGS. 4–7 for a description of the dipole antenna of this invention. FIG. 4 shows a top view; FIG. 5 a perspective view; FIG. 6A shows a cross section view, taken along line 6A–6A' of FIG. 4; and FIG. 6B shows a cross section view, taken along line 6B–6B'; of the dipole antenna. The dipole antenna has a first antenna element 42 and a second antenna element 40, both formed of conductive loaded resin-based material. In the example shown in FIGS. 4, 5, 6A, and 6B both the first antenna element 42 and second antenna element 40 have the shape of one half of a flat circular disk, however other shapes can be used with excellent results. The first antenna element 40 has a first outer periphery 43, which has a length equal to an integral multiple of one quarter wavelength of a first frequency. The second antenna element 42 has a second outer periphery 41, which has a length equal to an integral multiple of one quarter wavelength of a second frequency. The first frequency can be slightly different than the second frequency providing an optimum antenna response to a narrow band of frequencies and sharp frequency roll-off outside this band of frequencies. The first frequency can also be the same as the second frequency if desired.

A first bobbin core 76 formed of conductive loaded resin-based material is attached to the first antenna element 42 by first attachment elements 80 also formed of conductive loaded resin-based material. A second bobbin core 72 formed of conductive loaded resin-based material is attached to the second antenna element 40 by second attachment elements 78 also formed of conductive loaded resin-based material. A first coil 74 of conductive wire, having a first end 56 and a second end 58, is wound around the first bobbin core 76 thereby forming a number of turns of wire around the first bobbin core 76. A second coil 72 of conductive wire, having a first end 60 and a second end 62, is wound around the second bobbin core 72 thereby forming a number of turns of wire around the second bobbin core 72. The conductive wire has an insulating material formed thereon thereby insulating each of the turns of the conductive wire from the first 76 and second 72 bobbin cores and from the other turns of conductive wire wound on the first 76 and second 72 bobbin cores.

As shown in FIGS. 4 and 6, the first end 56 of the first coil 74 of conductive wire and the first end 60 of the second coil 70 of conductive wire are electrically connected to the center connector 52 of a coaxial cable 48. The second end 58 of the first coil 74 of conductive wire and the second end 62 of the second coil 70 of conductive wire are electrically connected to the outer shield 54 of the coaxial cable 48. The coaxial cable 48 is attached to a coaxial cable connector 50. In the case of a radiating antenna power is delivered to the antenna by means of the coaxial cable 48. In the case of a receiving antenna power is extracted from to the antenna by means of the coaxial cable 48.

Figure 7:
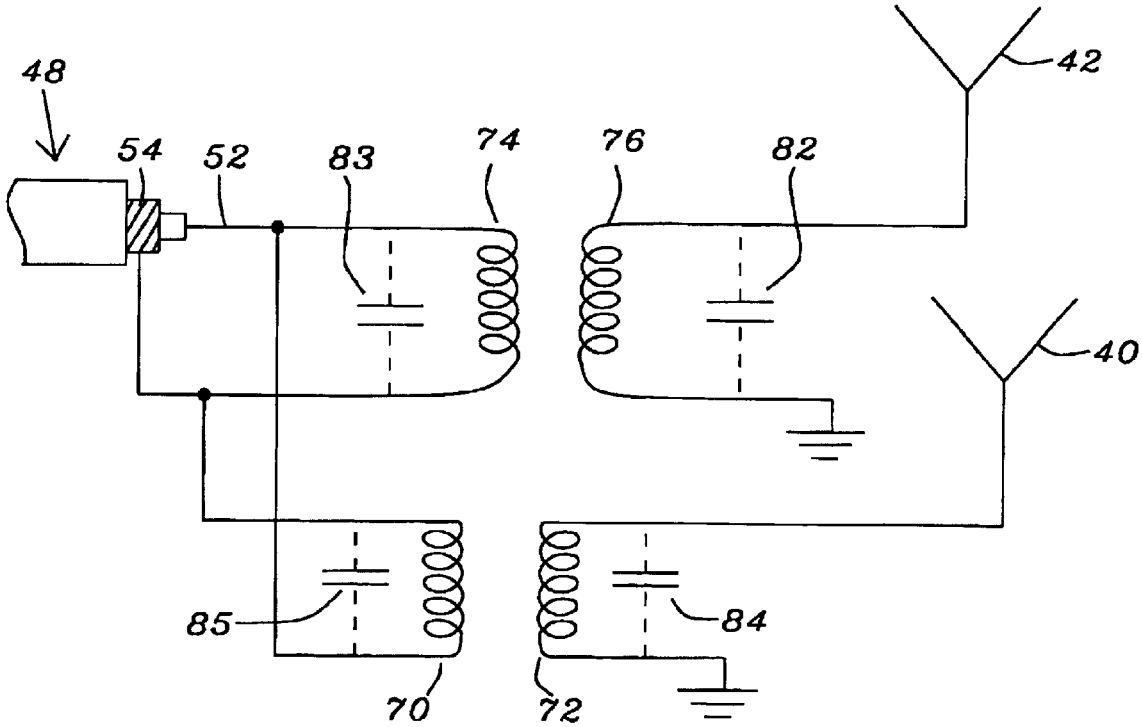
FIG. 7 shows a schematic view of the equivalent circuit of the dipole antenna of this invention.

FIG. 7 shows an equivalent circuit of the dipole antenna of this invention. The equivalent circuit shows the first antenna element 42, the first coil 74 of conductive wire, the first bobbin core 76, a capacitor 83 representing the capacitance of the first coil 74 of conductive wire, a capacitor 82 representing the capacitance of the first bobbin core 76, the second antenna element 40, the second coil 70 of conductive wire, the second bobbin core 72, a capacitor 85 representing the capacitance of the second coil 70 of conductive wire, and a capacitor 84 representing the capacitance of the second bobbin core 72. The first antenna element 42 is tuned to the first frequency by means of the length of the outer periphery 43 of the first antenna element 42 and the number of turns conductive wire in the first coil 74 of conductive wire, thereby controlling the inductance of the first coil 74 of wire. The second antenna element 40 is tuned to the second frequency by means of the length of the outer periphery 41 of the second antenna element 40 and the number of turns conductive wire in the second coil 70 of conductive wire, thereby controlling the inductance of the second coil 70 of wire. The first and second frequencies can be the same but are usually slightly skewed.

The center frequency of the antenna will be between the first and second frequencies if the first and second frequencies are different and will be the same as the first and second frequencies if the first and the second frequencies are the same. The first and second frequencies are usually within about 20% of the mean of the first and second frequencies. The antenna can be tuned to have a center frequency between 3 kilohertz and 300 gigahertz. In one useful configuration the antenna has a center frequency between 137 megahertz and 152 megahertz.

The dipole antenna described herein operates with excellent performance in close proximity to either a conductive or a non conductive surface.

The conductive loaded resin-based material used for the antennas in this invention contain micron conductive powders or micron conductive fibers to provide conductivity. These materials are resins loaded with conductive materials to provide a resin-based material which is a conductor rather than an insulator. The micron conductive powders are formed of metals such as nickel, copper, silver or the like. The micron conductive fibers can be nickel plated carbon fiber, stainless steel fiber, copper fiber, silver fiber, or the like. The structural material is a material such as a polymer resin. Structural material can be, here given as examples and not as an exhaustive list, polymer resins produced by GE PLASTICS, Pittsfield, Mass., a range of other plastics produced by GE PLASTICS, Pittsfield, Mass., a range of other plastics produced by other manufacturers, silicones produced by GE SILICONES, Waterford, N.Y., or other flexible resin-based rubber compounds produced by other manufacturers. The resin-based structural material loaded with micron conductive powders or fibers can be molded, using a method such as injection molding, overmolding, or extruded to the desired shape. The conductive loaded resin-based materials can be cut or milled as desired to form the desired shape of the antenna elements. The composition of the composite materials can affect the antenna characteristics and must be properly controlled. The composite could also be in the family of polyesters with woven or webbed micron stainless steel fibers or other micron conductive fibers forming a cloth like material which, when properly designed in metal content and shape, can be used to realize a very high performance cloth antenna. Such a cloth antenna could be embedded in a persons clothing as well as in insulating materials such as rubber or plastic. The woven or webbed conductive cloths could also be laminated to materials such as Teflon, FR-4, or any resin-based hard material.

While the invention has been particularly shown and described with reference to the preferred embodiments thereof, it will be understood by those skilled in the art that various changes in form and details may be made without departing from the spirit and scope of the invention.

What is claimed is:

1. An antenna, comprising:

an antenna element formed of conductive loaded resin-based materials, wherein said antenna element is flat having an outer periphery and said outer periphery has a length;

a bobbin core formed of said conductive loaded resin-based materials;

attachment elements formed of said conductive loaded resin-based materials wherein said attachment elements attach said bobbin core to said antenna element and form electrical connections between said bobbin core and said antenna element;

a length of conductive wire, having a first end and a second end, wound around said bobbin core thereby forming a number of turns of said conductive wire around said bobbin core, wherein said conductive wire has an insulating material formed thereon thereby insulating each of said turns of said conductive wire from said bobbin core and from other said turns of said conductive wire; and a center frequency related to said length of said outer periphery of said antenna element and said number of turns of said conductive wire around said bobbin core.

2. The antenna of claim 1 wherein said conductive loaded resin-based materials comprise micron conductive powders or micron conductive fibers.

3. The antenna of claim 1 wherein said conductive loaded resin-based materials comprise micron conductive powders or micron conductive fibers and a resin host, the ratio of the weight of said micron conductive powders or micron conductive fibers to the weight of said resin host is between about 0.14 and 0.80, and the resistivity of said conductive loaded resin based materials is between about 5 and 25 ohms per square.

4. The antenna of claim 1 wherein said length of said outer periphery of said antenna element is an integral multiple of one quarter wavelength of said operating frequency.

5. The antenna of claim 1 wherein said conductive loaded resin-based materials comprises petrochemicals.

6. The antenna of claim 1 wherein said conductive loaded resin-based materials comprises silicones.

7. The antenna of claim 1 wherein said conductive loaded resin-based materials comprises polyesters with woven or webbed micron conductive fibers forming a cloth like material.

8. The antenna of claim 1 wherein said antenna can be a radiating antenna, a receiving antenna, or both.

9. The antenna of claim 1 wherein said center frequency is between about 3 kilohertz and 300 gigahertz.

10. The antenna of claim 1 further comprising a coaxial cable having a center connector electrically connected to said first end of said length of conductive wire and an outer conductor connected to said second end of said length of conductive wire whereby electrical power can be delivered to or extracted from said antenna.

11. The antenna of claim 1 wherein said antenna element has the shape of a circular disk.

12. An antenna, comprising:

a first antenna element formed of conductive loaded resin-based materials, wherein said first antenna element is flat having a first outer periphery and said first outer periphery has a first length;

a second antenna element formed of conductive loaded resin-based materials, wherein said second antenna element is flat having a second outer periphery and said second outer periphery has a second length;

a first bobbin core formed of said conductive loaded resin-based materials;

a second bobbin core formed of said conductive loaded resin-based materials;

first attachment elements formed of said conductive loaded resin-based materials wherein said first attachment elements attach said first bobbin core to said first antenna element and form electrical connections between said first bobbin core and said first antenna element;

second attachment elements formed of said conductive loaded resin-based materials wherein said second attachment elements attach said second bobbin core to said second antenna element and form electrical connections between said second bobbin core and said second antenna element;

a first length of conductive wire, having a first end and a second end, wound around said first bobbin core thereby forming a first number of turns of said conductive wire around said first bobbin core wherein said conductive wire has an insulating material formed thereon thereby insulating each of said first turns of said conductive wire from said first bobbin core and from other said first turns of said conductive wire;

a second length of said conductive wire, having a first end and a second end, wound around said second bobbin core thereby forming a second number of turns of said conductive wire around said second bobbin core wherein said conductive wire has an insulating material formed thereon thereby insulating each of said second turns of said conductive wire from said second bobbin core and from other said second turns of said conductive wire;

a first frequency related to said first number of turns of said conductive wire wound around said first bobbin core and said first length of said first outer periphery of said first antenna element;

a second frequency related to said second number of turns of said conductive wire wound around said second bobbin core and said second length of said second outer periphery of said second antenna element; and a center frequency related to said first frequency and said second frequency.

13. The antenna of claim 12 wherein said center frequency is between said first frequency and said second frequency.

14. The antenna of claim 12 wherein said center frequency, said first frequency, and said second frequency are equal.

15. The antenna of claim 12 wherein said conductive loaded resin-based materials comprise micron conductive powders or micron conductive fibers.

16. The antenna of claim 12 wherein said conductive loaded resin-based materials comprise micron conductive powders or micron conductive fibers and a resin host, the ratio of the weight of said micron conductive powders or micron conductive fibers to the weight of said resin host is between about 0.14 and 0.80, and the resistivity of said conductive loaded resin based materials is between about 5 and 25 ohms per square.

17. The antenna of claim 12 wherein said first length of said first outer periphery of said first antenna element is an integral multiple of one quarter wavelength of said first center frequency.

18. The antenna of claim 12 wherein said second length of said second outer periphery of said second antenna element is an integral multiple of one quarter wavelength of said second center frequency.

19. The antenna of claim 12 wherein said conductive loaded resin-based materials comprises petrochemicals.

20. The antenna of claim 12 wherein said conductive loaded resin-based materials comprises silicones.

21. The antenna of claim 12 wherein said conductive loaded resin-based materials comprises polyesters with woven or webbed micron conductive fibers forming a cloth like material.

22. The antenna of claim 12 wherein said antenna can be a radiating antenna, a receiving antenna, or both.

23. The antenna of claim 12 wherein said first frequency is about 137 megahertz and said second frequency is about 152 megahertz.

24. The antenna of claim 12 wherein said center frequency is between 137 megahertz and 152 megahertz.

25. The antenna of claim 12 wherein said first frequency and said second frequency are within about 20% of the mean of said first frequency and said second frequency.

26. The antenna of claim 12 wherein said center frequency is between about 3 kilohertz and 300 gigahertz.

27. The antenna of claim 12 further comprising a coaxial cable having a center connector electrically connected to said first end of first length of conductive wire and to said second end of said second length of conductive wire, and an outer conductor connected to said second end of said first length of conductive wire and said first end of said second length of conductive wire whereby electrical power can be delivered to or extracted from said antenna.

28. The antenna of claim 12 wherein said first antenna element and said second antenna element each have the shape of one half of a circular disk.

29. The antenna of claim 12 wherein said first antenna element and said second antenna element lie in the same plane.

30. The antenna element of claim 12 wherein said first antenna element is the mirror image of said second antenna element.

* * * * *